United States Patent [19]

Laul

[11] Patent Number: 4,761,548

[45] Date of Patent: Aug. 2, 1988

[54] OPTICALLY TRIGGERED HIGH VOLTAGE SWITCH WITH CESIUM VAPOR

[75] Inventor: Virgil R. Laul, Dana Point, Calif.

[73] Assignee: Northrop Corporation, Hawthorne, Calif.

[21] Appl. No.: 943,975

[22] Filed: Dec. 18, 1986

[51] Int. Cl.[4] ..... H01J 40/14; H05B 37/02

[52] U.S. Cl. ..... 250/211 R; 315/150; 313/638; 313/550; 313/15; 313/564; 313/611

[58] Field of Search ..... 372/11, 86, 87, 82; 250/211 R; 313/638, 643, 15, 550, 564, 611, 150; 315/112, 115

[56] References Cited

U.S. PATENT DOCUMENTS

| | | | |
|---|---|---|---|
| 2,457,950 | 1/1949 | Thomas | 313/611 |
| 2,489,891 | 11/1949 | Hull | 313/564 |
| 3,436,566 | 4/1969 | Langpape et al. | 313/638 |
| 3,524,101 | 8/1970 | Barbini | 315/150 |
| 3,739,227 | 6/1973 | Nastjukha et al. | 313/611 |
| 4,173,728 | 11/1979 | Witting | 313/638 |
| 4,176,297 | 11/1979 | Thistle et al. | 315/150 |
| 4,401,920 | 8/1983 | Taylor et al. | 313/643 |
| 4,645,974 | 2/1987 | Asai | 315/112 |
| 4,709,185 | 11/1987 | Hoeberechts et al. | 313/550 |

*Primary Examiner*—David C. Nelms

*Assistant Examiner*—Michael Messinger

*Attorney, Agent, or Firm*—Terry J. Anderson; Robert B. Block

[57] ABSTRACT

An electric arc discharge switch having less susceptibility to electrode erosion and capable of being optically triggered. In a first embodiment the switch includes a gas tight body defining a hollow interior with electrodes mounted onto the body and forming a conducting path into the body interior. Portions of the body are optically transmissive to light frequencies above the photoelectric effect cutoff frequency for cesium vapor. A buffer gas and a predetermined quantity of vaporizable cesium are disposed within the hollow body interior and a flash lamp may be mounted onto the switch exterior. In operation, light frequencies above the photoelectric effect cutoff frequency for cesium are introduced into the switch body, ionizing the cesium vapor therein and reducing the resistance and breakdown voltage between the electrodes so as to initiate an electric arc. In an alternative embodiment a control plate with an aperture is disposed within the switch body between the electrodes. The control plate provides better control over electric arc formation and switch "turn-on."

12 Claims, 1 Drawing Sheet

OPTICALLY TRIGGERED HIGH VOLTAGE SWITCH WITH CESIUM VAPOR

BACKGROUND OF THE INVENTION

1. Field of the Invention

The present invention concerns high voltage switches and, more particularly, electric arc discharge or spark gap type switches.

2. Description of the Prior Art

High voltage switches capable of providing interruptable current paths for voltages in excess of several kilovolts have a number of diverse applications. These switches are also particularly useful if they further have the capacity to handle large current loads as well. Switches of this type are commonly used, for example, to discharge high energy capacitor banks and switch on various types of high power lasers. Because of the high voltages and, in some applications, high currents involved, solid state electronic devices, such as power MOSFETS and the like, are seldom capable of providing an adequate switching mechanism. Similarly, electro-mechanical devices, such as relays, are also of limited use since they are subject to electrical shorting and/or contact fusing (causing a permanent "switch-on" condition) if the operating voltages and currents are high enough.

One type of switching device commonly employed for very high voltages and/or high voltage-high current applications is the electric arc discharge or "spark gap" type switch. Spark gap switches typically include some sort of gas-tight body containing an inert gas and a pair of rugged switching electrodes mounted in opposing sides of the body structure. In operation, the voltage across the electrodes is raised above the electrical breakdown potential of the gas, causing an arc to form between the electrodes through the gas. An electrical current then flows through the switch until the source voltage to the switch is dissipated. Alternatively, an electrical probe may be positioned between the electrodes with the discharge arc initiated by raising the voltage between the probe and one of the electrodes above the breakdown potential for the gas.

While very useful for a diverse number of high voltage switching applications, spark gap switches suffer from several disadvantages. If a probe is employed to initiate the discharge arc, the switching circuit for raising the voltage of the probe must be isolated from the high voltage source of the electrodes in order to prevent shorting between the probe circuitry and the high voltage source. In spark gap switches which do not employ a probe, it is sometimes desirable, though generally not possible, to activate the switch at voltages below the breakdown voltage of the gas contained in the switch. In addition, the discharge arc or "spark current" present between the electrodes during activation of the switch typically causes erosion of the electrode material. This erosion usually affects the voltage at which the spark gap switch turns on by altering the shape of the electrodes and by plating the interior of the switch body with metal removed from the electrodes. The electrode material plating provides an alternate current path through the switch body which, over time, has a resistance much lower than the resistance of the gas contained in the switch, causing the switch to turn "on" at an undesirably lower voltage. Consequently, spark gap type switches must be periodically disassembled and the electrode plating removed from the interior of the switch body or the "switch-on" voltage may become erratic and undesirably low.

Thus, there exists a need for an improved spark gap type switch which is less susceptible to electrode erosion and more easily activated over a range of voltages.

SUMMARY OF THE INVENTION

It is therefore an object of the present invention to provide a spark gap type switch which does not require a probe electrode and is capable of being activated at voltages lower than the normal breakdown voltage of the gas within the switch. It is a further object of the present invention to provide a spark gap type switch which is less susceptible to electrode erosion.

These and other goals and objectives are achieved in the present invention by providing an electric arc discharge type switch which may be optically triggered. In a preferred first embodiment of the present inventive switch, a predetermined quantity of cesium vapor is provided along with a buffer gas in a switch structure. To trigger the switch, light having a frequency above the photoelectric effect cutoff frequency for cesium is introduced into the interior of the switch. This light frees electrons from atoms of the cesium vapor, reducing the resistance of the cesium vapor-buffer gas mixture to the point where an electric arc readily forms. Because of the low work function of cesium, light in the high frequency end of the visible spectrum (blue) or, alternatively, ultraviolet light can be used to trigger the switch. The switch structure includes an insulated gas tight container having a pair of electrodes mounted onto the container and forming an electrically conducting path into the interior of the container. The entire container, or a portion of the container, is optically transmissive to light frequencies above the photoelectric effect cutoff frequency for cesium. A heating element also may be added to raise the temperature of the switch and vary the cesium vapor density, thus affecting the voltage at which the present inventive switch turns on. A flash lamp may further be provided to trigger the arc discharge within the switch if another controllable light source of suitable light frequency is not available.

Erosion of the switching electrodes is also minimized by the presence of the cesium vapor in the switch. Cesium atoms within the vapor will condense onto the switching electrodes and, because of the low cesium work function, the ionization potential of the cesium plating is typically much lower than the ionization potential of the electrode material. Thus the discharge arc first removes cesium atoms from the surface of the switching electrodes (atoms being continuously replaced from the vapor) before attacking the electrodes themselves.

The novel features which are believed to be characteristic of the present invention, together with further objectives and advantages thereof, will be better understood from the following detailed description considered in connection with the accompanying drawings, wherein like numbers designate like elements. It should be expressly understood, however, that the drawings are for purposes of illustration and description only and are not intended as a definition of the limits of the invention.

DETAILED DESCRIPTION

Figure 1:
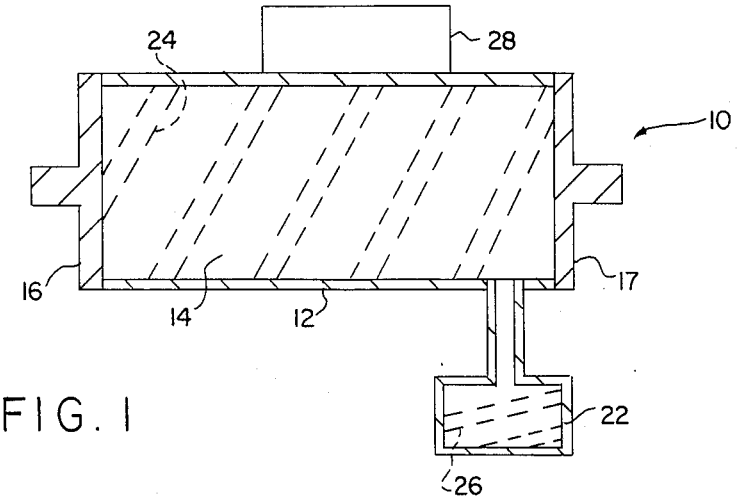
FIG. 1 is a side view of a first embodiment of the present inventive electric arc discharge switch.

Referring to the figures, and more particularly FIG. 1, there is shown a first preferred embodiment of the present inventive switch 10, including a body portion 12 defining a hollow interior 14 and electrodes 16, 17. While illustrated as having a generally cylindrical configuration, the body portion 12 may have any desired geometric configuration defining a generally hollow interior 14. The body 12 is preferably made of a material which is optically transmissive to light frequencies above the photoelectric effect cutoff frequency for cesium (generally frequencies extending from about the blue end of the visible spectrum into the ultraviolet). Such materials include, for example, synthetic sapphire, a generally commercially available material, and LUCALOX (TRADEMARK), a compound manufactured by Westinghouse Company. Alternatively, however, the body portion 12 could be made from materials which are not optically transmissive to light frequencies above the cesium photoelectric effect cutoff frequency with an optically transmissive window (not shown) provided at a convenient location on the body 12.

Attached to the ends of the body 12 are a pair of electrodes 16, 17 having any suitable configuration for facilitating the formation of an electric arc discharge between them. The electrodes 16, 17 may be made from any of various conventional electrode materials such as, for example, tungsten, molybdemum, tantalum, and the like and are bonded to the body 12 by any of various conventional processes so that the electrodes 16, 17 and body 12 form a hermetically sealed gas-tight container.

A quantity of vaporizable cesium is disposed within the gas tight interior 14 along with a suitable buffer gas which may be hydrogen or any inert gas which does not generally react with cesium. In this embodiment, a reservoir 22 containing a quantity of vaporizable cesium may be attached to the body 12 with the interior of the reservoir communicating with the switch interior 14 to provide finer control of the cesium vapor partial pressure within the switch interior 14. Separate heating elements 24, 26 may be disposed about the switch body 12 and reservoir 22 respectively. These heating elements 24, 26 may be any suitable device such as, for example, nichrome wire. The partial pressure of cesium vapor within the switch interior 14 is controlled by adjusting the temperature of the switch body 12 and reservoir 22 by the heating elements 24, 26. This partial cesium vapor pressure within the switch interior 14 generally establishes the limit of current density which can be conducted by the switch 10 in an "on" condition.

To initiate an arc discharge within the interior 14 and turn "on" the switch 10, a flashlamp 28 may be attached to the exterior of the switch body 12 or, alternatively, mounted to any convenient support structure (not shown) adjacent to the switch body 12. The flashlamp 28 may be any convenient light source generating light including frequencies above the photoelectric effect cutoff frequency for cesium. As discussed above these frequencies extend from approximately the far blue end of the visible spectrum into the ultraviolet. In operation, the heating elements 24, 26 are energized and a desired temperature and corresponding cesium vapor pressure achieved in the switch interior 14. A quantity of cesium from the vapor will also condense onto the electrodes 16, 17. An electric arc discharge is initiated between electrode 16, 17 by activating the flashlamp 28 to partially ionize cesium atoms in the cesium vapor-buffer gas mixture. The presence of the ionized cesium atoms and free charges within the switch interior 14 substantially reduces the resistance and breakdown voltage between the electrodes 16, 17 causing an electrical arc to form. The switch 10 will then be in an "on" state and remain in this state until the voltage across the electrodes 16, 17 drops.

Since switching is achieved by optical triggering, the triggering circuitry activating the flashlamp is not normally subjected to the high voltages across the electrodes 16, 17. Thus, special protection of the triggering circuitry against shorting with the high voltage source is not required. While the arc discharge is present between the electrodes 16, 17, the relatively low work function of cesium will cause cesium atoms condensed onto electrodes 16, 17 made of conventional materials to be dislodged from the electrodes (as discussed above) before atoms of the electrodes are themselves removed, thus reducing erosion by the electric arc.

Figure 2:
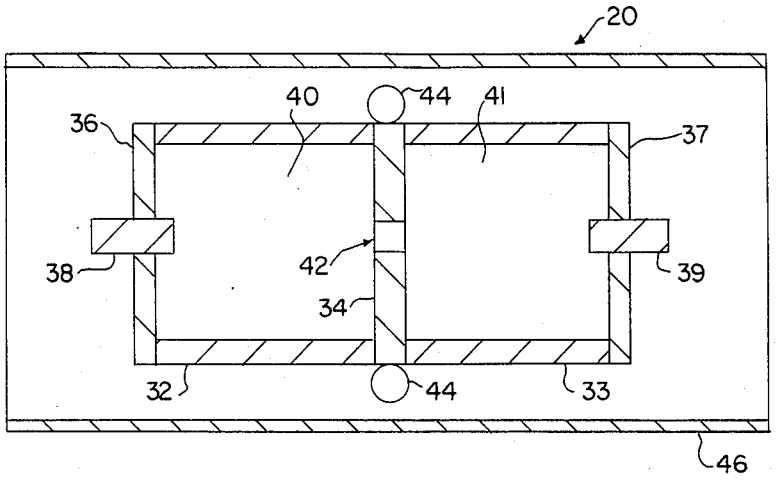
FIG. 2 is a side view of a second embodiment of the present inventive switch.

In FIG. 2 an alternative embodiment of the present inventive switch 20 is illustrated. The switch body in this embodiment includes two portions 32, 33 bonded to a control plate 34. As in the first embodiment, the body portions 32, 33 may have any convenient geometrical configuration defining a hollow interior. In this embodiment, however, the body portions 32, 33 may be, but need not necessarily be, optically transmissive. End caps 36, 37 are bonded by conventional methods to the open ends of the body portions 32, 33 with appropriately configured electrodes 38, 39 bonded to and projecting through the end caps 36, 37 to form a gas tight container. Alternatively, the electrodes 38, 39 may be suitably configured to serve as the end caps in the same manner as electrodes 16, 17 in the first embodiment shown in FIG. 1.

The control plate 34 divides the interior of the switch 20 into two chambers 40, 41 and is provided with a generally centrally disposed aperture 42 aligned between the two chambers 40, 41. These chambers and the aperture 42 are filled with a predetermined mixture of vaporizable cesium and a buffer gas of suitable type as discussed above. This control plate 34 is made of material optically transmissive for light frequencies above the photoelectric effect cutoff frequency for cesium such as, for example, the synthetic sapphire or LUCALOX (TRADEMARK) materials discussed above in the first embodiment. A flashlamp 44 is also disposed about the control plate 34 so as to direct light onto the control plate 34 and into the aperture 42 (as well as the chambers 40, 41 if the body portions 32, 33 are appropriately optically transmissive). If desired, a heating element may be wrapped about the body portions 32, 33 or, alternatively, the entire switch assembly may be disposed in a heated liner 46.

In operation, this embodiment of the presently inventive switch 20 operates in essentially the same manner as the switch 10 discussed above. The switch 20 may be heated to obtain a desired cesium vapor pressure within the chambers 40, 41 and aperture 42 and then the flashlamp 44 activated to provide light which ionizes the atoms of the cesium vapor, in turn causing an electric arc to form between the electrodes 38, 39. Use of the control plate 34 restricts the path of an electric arc within the interior of the switch 20 and provides more accurate control of when an electric arc forms since stray photons within the switch 20 capable of ionizing cesium vapor atoms will be less likely to cause arc formation.

It will, of course, be understood that modifications of the present invention will be apparent to others skilled in the art. For example, the flashlamp may be eliminated if cesium ionizing light frequencies are available from another source. If the flashlamp, or alternate light source, has a sufficient light flux density (intensity) the heating elements will not be needed to raise the cesium vapor partial pressure. Consequently, the scope of the present invention should not be limited by the particular embodiments discussed above, but should be defined only by the claims set forth below and equivalents thereof.

What is claimed is:

1. A high voltage arc discharge type switch for closing two parts of a high voltage circuit and capable of being optically triggered, comprising:

an insulating body having a hollow interior, at least a portion of the body being optically transmissive to a cesium ionizing light frequency;

a first and a second electrode attached to the insulating body and electrically communicating with the interior of the body, the insulating body and electrodes forming a gas tight container;

said electrode further being connected to each said circuit part respectively;

a predetermined quantity of vaporizable cesium disposed within the insulating body hollow interior;

flash lamp means for directing cesium vapor ionizing light through said interior, a predetermined quantity of buffer gas disposed within the insulating body hollow interior, wherein a resistance between the first and second electrodes is reduced when a cesium ionizing light is directed through the optically transmissive portion of the insulating body into the hollow interior, triggering the high voltage switch.

2. The high voltage switch of claim 1 further comprising a flash lamp attached to the insulating body and aligned with the optically transmissive portion of the insulating body so as to direct light from the flash lamp into the hollow interior, said flash lamp generating light including a cesium ionizing frequency.

3. The high voltage switch of claim 1 further comprising heating means for raising the temperature of the insulating body interior and vaporizing a quantity of the cesium disposed within the insulating body.

4. The high voltage switch of claim 1 further comprising a reservoir, containing a predetermined quantity of vaporizable cesium, attached to the insulating body and communicating with the insulating body hollow interior.

5. The high voltage switch of claim 4 further comprising heating means for raising the temperature of the reservoir and vaporizing a quantity of the cesium contained within the reservoir.

6. The high voltage switch of claim 1 further comprising an insulating plate, optically transmissive to a cesium ionizing light frequency, disposed within the insulating body hollow interior between the first and second electrodes, said insulating plate having an aperture and an edge aligned with the optically transmissive portion of the insulating body.

7. An optically triggered high voltage spark gap type switch, comprising:

a high voltage insulating body having a generally hollow interior with at least a portion of the body optically transmissive to a light frequency above the photoelectric effect cutoff frequency of cesium vapor;

a first and a second electrode attached to the insulating body and forming an electrically conducting path from the exterior to the hollow interior of the insulating body, the first and second electrodes and the insulating body forming a gas tight container;

a control plate disposed within the insulating body hollow interior between the first and second electrodes, having an edge aligned with the optically transmissive portion of the insulating body and dividing the insulating body hollow interior into a first and a second chamber, said control plate defining an aperture between the first and second chambers and further being optically transmissive to a light frequency above the photoelectric effect cutoff frequency of cesium vapor;

a predetermined quantity of vaporizable cesium disposed within the hollow interior of the insulating body; and a predetermined quantity of buffer gas disposed within the insulating body hollow interior, wherein a resistance between the first and second electrodes is decreased when light having a frequency above the photoelectric effect cutoff frequency for cesium vapor is directed into the insulating body hollow interior, thereby triggering the switch when a high voltage potential is placed across the electrodes.

8. The switch of claim 7 further comprising a flash lamp, generating light including a frequency above the photoelectric effect cutoff frequency for cesium vapor, mounted on the insulating body and aligned with the optically transmissive portion of the insulating body so as to direct flash lamp generated light onto said control plate.

9. The switch of claim 7 further comprising heating means for raising the temperature of the insulating body and vaporizing a quantity of the cesium disposed within the insulating body.

10. The switch of claim 7 further comprising a reservoir, attached to the insulating body and communicating with the hollow interior of the insulating body, said reservoir containing a quantity of vaporizable cesium.

11. The switch of claim 10 further comprising heating means, attached to the reservoir, for raising the temperature of the reservoir and vaporizing a portion of the cesium disposed within the reservoir.

12. A high voltage arc discharge type switch for connecting two parts of a high voltage circuit and capable of being optically triggered, comprising:

an insulating body having a hollow interior;

first and second electrodes attached to the insulating body and electrically communicating with the interior of the body, said insulating body and electrodes forming a gas tight container;

said electrode further being connected to each said circuit part respectively, a predetermined quantity of cesium vapor disposed within the insulating body hollow interior; and flash lamp means for emitting a cesium vapor ionizing light frequency directed through the interior of the insulating body so that the resistance between the first and second electrodes is reduced thereby triggering the initiation of an arc discharge connecting the high voltage circuit.

* * * * *